US009483966B2

(12) United States Patent
Carolan

(10) Patent No.: US 9,483,966 B2
(45) Date of Patent: Nov. 1, 2016

(54) THREE-DIMENSIONAL BILLBOARD DISPLAYS WITH REINFORCED FLEXIBLE BANNER AND ATTACHED INFLATABLE EMBELLISHMENT

(71) Applicant: Edward Francis Carolan, Caledon (CA)

(72) Inventor: Edward Francis Carolan, Caledon (CA)

( * ) Notice: Subject to any disclaimer, the term of this patent is extended or adjusted under 35 U.S.C. 154(b) by 0 days.

(21) Appl. No.: 14/858,245

(22) Filed: Sep. 18, 2015

(65) Prior Publication Data

US 2016/0232823 A1 Aug. 11, 2016

Related U.S. Application Data

(60) Provisional application No. 62/055,270, filed on Sep. 25, 2014.

(51) Int. Cl.
*G09F 15/00* (2006.01)
*G09F 7/18* (2006.01)

(52) U.S. Cl.
CPC ..... *G09F 15/00* (2013.01); *G09F 7/18* (2013.01); *G09F 2007/1886* (2013.01); *G09F 2015/0093* (2013.01)

(58) Field of Classification Search
CPC .. G09F 15/00; G09F 7/18; G09F 2007/1886; G09F 2015/0093
See application file for complete search history.

(56) References Cited

U.S. PATENT DOCUMENTS

| | | | | |
|---|---|---|---|---|
| 4,271,620 | A * | 6/1981 | Vicino | G09F 19/08 40/406 |
| 5,373,655 | A * | 12/1994 | Suzuki | G09F 7/18 40/590 |
| 6,216,374 | B1 * | 4/2001 | Lawrence | G09F 3/20 40/604 |
| 2009/0183408 | A1 * | 7/2009 | Dicke | G09F 15/0037 40/610 |
| 2010/0199535 | A1 * | 8/2010 | Reynolds | G09F 15/02 40/603 |
| 2011/0225860 | A1 * | 9/2011 | Troiano | G09F 7/08 40/601 |

* cited by examiner

*Primary Examiner* — Gary Hoge
(74) *Attorney, Agent, or Firm* — Kyle R. Saherthwaite; Ryan W. Dupuis; Ade & Company Inc.

(57) ABSTRACT

A 3D billboard display features a flexible banner having a display side, strips of reinforcement material attached to the flexible banner, and a flexible envelope fastened to the strips of reinforcement material and carried on the display side of the banner. The envelope forms an inflatable space that is fully or substantially enclosed by the flexible envelope, or a by a combination of the flexible envelope and the flexible banner. When inflated, the flexible envelope bulges away from the display side of the flexible sheet to create a three-dimensional display unit carried on the flexible banner. The resulting display is a one-piece shipment that is installation-ready, with no special modification or assembly required at the billboard site, where mere placement of the flexible banner on the billboard support structure and activation of an on-board inflation mechanism is all that's required.

19 Claims, 6 Drawing Sheets

LIVE AREA TRIM

| LEGEND | |
|---|---|
| Outline Of Inflatable | |
| Webbing | |
| Zippers | |
| Stitching | |

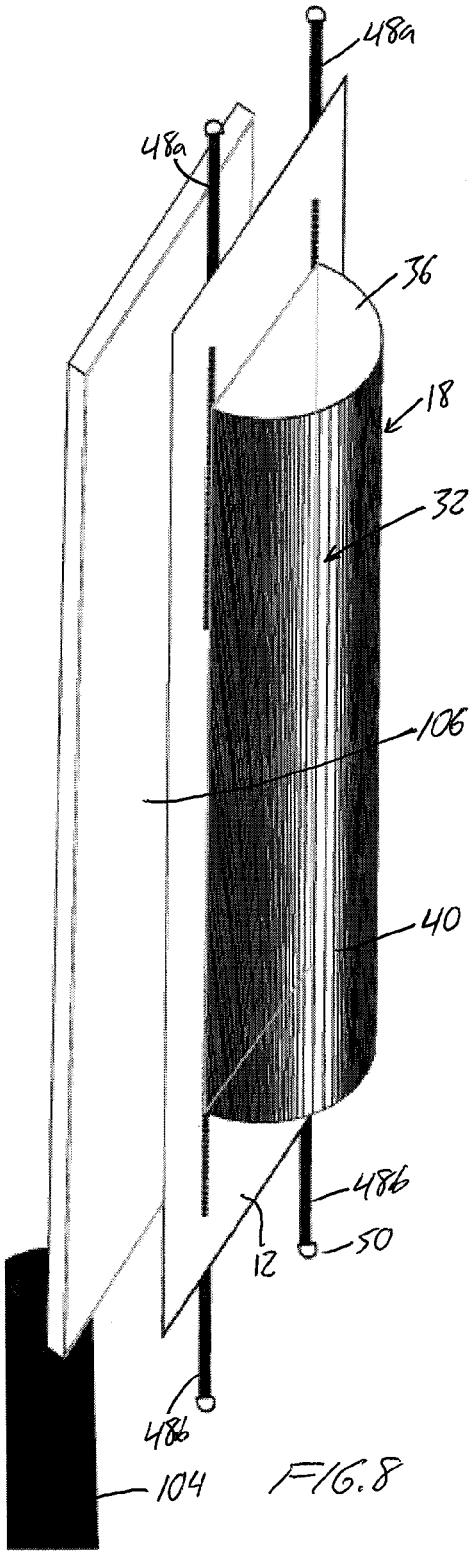
FIG. 8
FIG. 9
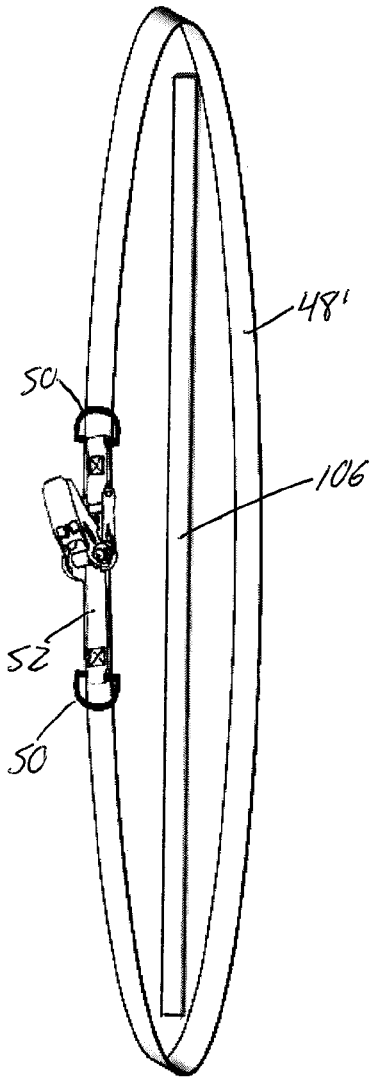

THREE-DIMENSIONAL BILLBOARD DISPLAYS WITH REINFORCED FLEXIBLE BANNER AND ATTACHED INFLATABLE EMBELLISHMENT

CROSS REFERENCE TO RELATED APPLICATIONS

This application claims benefit under 35 U.S.C. 119(e) of Provisional Application Ser. No. 62/055,270, filed Sep. 25, 2014.

FIELD OF THE INVENTION

The present invention relates generally to billboards used for advertisement, promotional or informational purposes, and more particularly to billboards with inflatable three-dimensional display components.

BACKGROUND

It has been known in the prior art to add three-dimensional embellishments to conventional two-dimensional billboards by attaching an inflatable unit to the display side of a billboard, whereupon inflation of the unit imparts a three-dimensional shape to the attachment that bulges outward from the remainder of the billboard's flat face. Previously, such installation relied on a multi-step installation process in which a vinyl banner is installed over the plywood facing of a billboard frame in a conventional manner, at which point a separate inflatable component is then lifted up to the billboard and fastened into the plywood facing of the billboard frame through the already-placed vinyl banner.

In view of the notable expense of an installation crew and crane operator, there is a desire to provide a three-dimensional billboard solution that reduces the time and complexity of the on-site installation process.

SUMMARY OF THE INVENTION

According to a first aspect of the invention, there is provided a three-dimensional billboard display comprising:

a flexible sheet of banner material having advertisement, promotional or informational content on a display side of said flexible sheet;

strips of reinforcement material attached to said flexible sheet in positions lying along boundaries of a two-dimensional area;

a flexible envelope fastened to the strips of reinforcement material and carried on the flexible sheet on the display side thereof in a position overlying the two-dimensional area and forming an inflatable space that is fully or substantially enclosed by the flexible envelope, or a by a combination of said flexible envelope and said flexible sheet;

whereby inflation of the inflatable space expands the flexible envelope in a manner bulging away from the display side of the flexible sheet to create a three-dimensional display unit on said flexible sheet of banner material.

Preferably the strips of reinforcement material are attached to a rear side of the flexible sheet that faces opposite the display side thereof, and the flexible envelope is fastened to the strips of reinforcement material through the flexible sheet.

Preferably the flexible envelope is sewn to the strips of reinforcement material.

Preferably there are additional reinforcement strips attached to the flexible envelope and fastened to the flexible sheet.

Preferably the additional reinforcements strips are fastened to the strips of reinforcement material through the sheet of flexible material.

Preferably the strips of reinforcement material comprise webbing.

Preferably the additional reinforcement strips comprise webbing.

Preferably there is at least one securing strap attached to the flexible sheet at a rear face thereof that faces opposite the display side of the flexible sheet, the at least one securing strap being arranged secure the flexible sheet securely to a billboard support structure.

Preferably the at least one securing strap is arranged to close around one or more framing members of billboard support structure in a tightenable manner embracing over and under said one or more framing members.

Preferably there is at least one ratchet mechanism installed on the at least one securing strap for tightening of said securing strap to the billboard frame.

Preferably the at least one securing strap is attached to at least one of the strips of reinforcement material.

Preferably the at least one securing strap comprises a same fabric as the strips of reinforcement material.

According to a second aspect of the invention, there is provided a flexible banner for use in a three-dimensional billboard display, the flexible banner comprising a flexible sheet of banner material having advertisement, promotional or informational content on a display side of said flexible sheet; and strips of reinforcement material attached to said flexible sheet in positions lying along boundaries of a two-dimensional area to enable fastening of a flexible envelope to the strips of reinforcement material on the display side of the flexible sheet in a position overlying the two-dimensional area and forming an inflatable space that is substantially enclosed by the flexible envelope, or by a combination of said flexible envelope and said flexible sheet, such that inflation of the inflatable space will expand the flexible envelope in a manner bulging away from the display side of the flexible sheet to create a three-dimensional display unit on said flexible sheet of banner material.

According to a third aspect of the invention, there is provided a flexible envelope for cooperation with a flexible banner to define a three-dimensional billboard display, the a flexible envelope enclosing an inflatable space and including a rear panel to which reinforcement strips are attached for coupling of the flexible envelope to the flexible banner by fastening of the reinforcement strips of the flexible envelope to the flexible banner in order support the flexible envelope at the display side of the flexible banner such that inflation of the inflatable space will expand the flexible envelope in a manner bulging away from the display side of the flexible banner to create a three-dimensional display unit on said flexible banner.

According to a fourth aspect of the invention, there is provided a method of creating a three-dimensional billboard display, the method comprising fastening a flexible envelope to reinforced areas of a flexible banner in a position fully or substantially enclosing an inflatable space within the flexible envelope, or between the flexible envelope and the flexible banner, such that inflation of the inflatable space will expand the flexible envelope in a manner bulging away from the display side of the flexible banner to create a three-dimensional display unit on said flexible banner.

BRIEF DESCRIPTION OF THE DRAWINGS

One embodiment of the invention will now be described in conjunction with the accompanying drawings in which:

FIG. 8 is a schematic perspective side view of the installation of the billboard on the framework of the billboard support structure.

FIG. 9 schematically illustrates the use of the securing straps to secure the display to the framework of the billboard support structure In the drawings like characters of reference indicate corresponding parts in the different figures.

DETAILED DESCRIPTION

Figure 1:
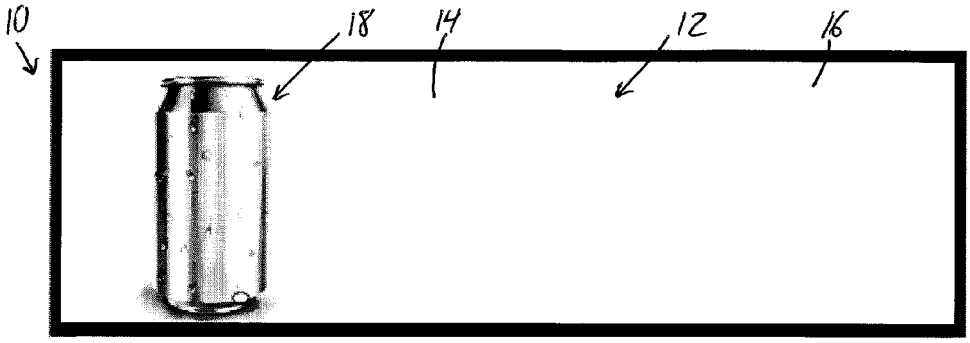
FIG. 1 is a front elevational view of a three-dimensional billboard display of the present invention.
Figure 4:
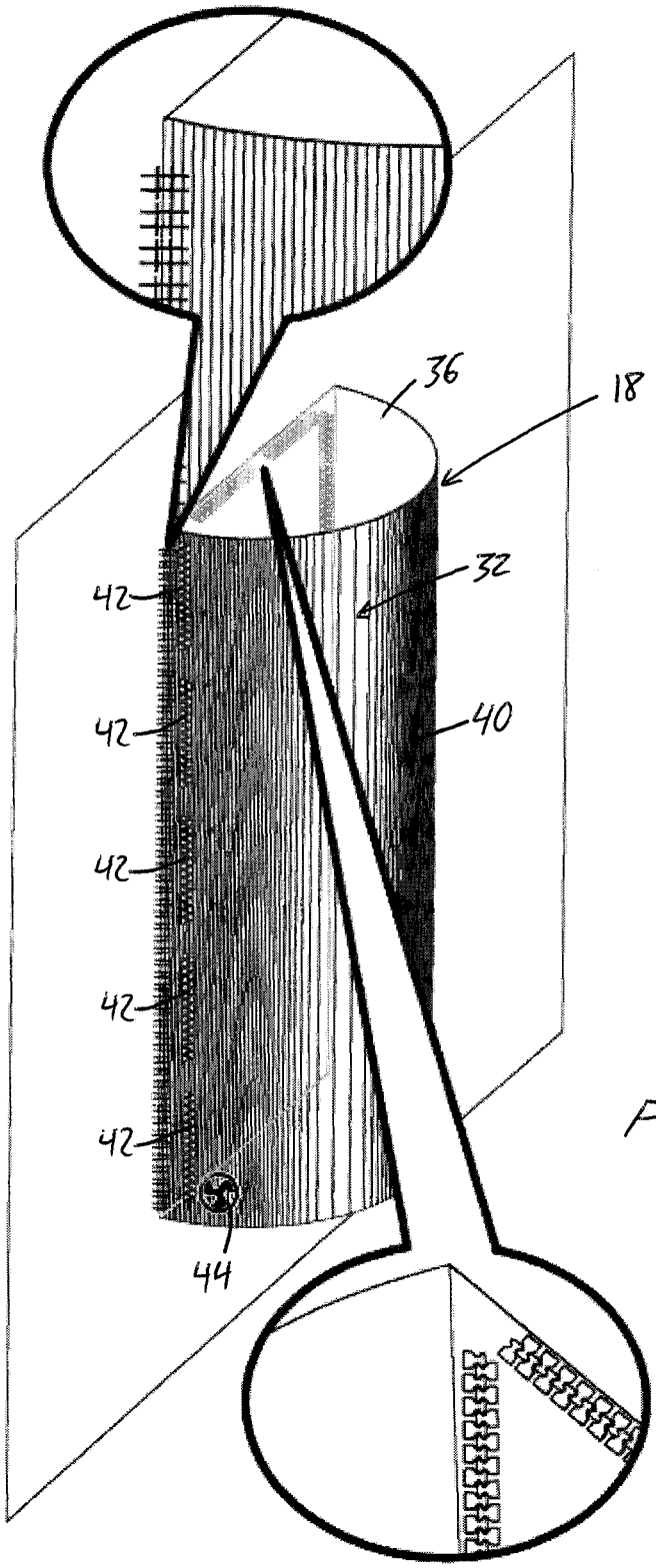
FIG. 4 is a schematic perspective view illustrating the finished billboard with the embellishment supported on the flexible banner in an inflated state, thereby adding a three-dimensional aspect of the overall display.
Figure 5A:
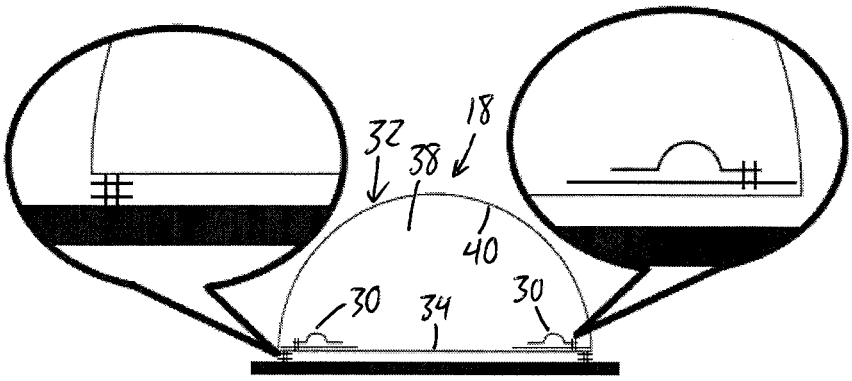
FIG. 5A is a schematic cross-sectional view illustrating sewn attachment of the inflatable embellishment to the flexible banner at reinforced edge portions of a rear panel of the inflatable embellishment.
Figure 5B:
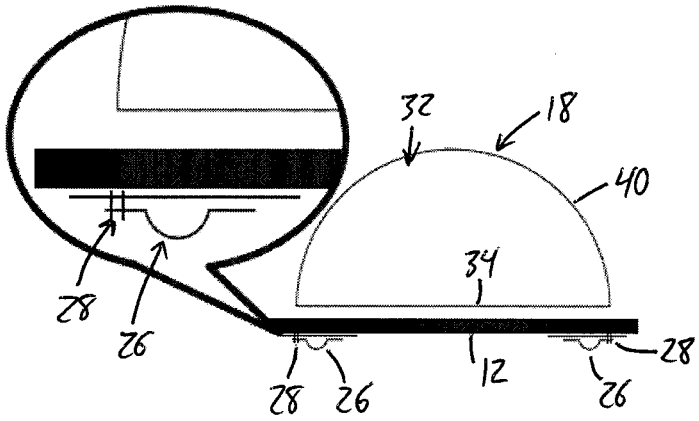
FIG. 5B is a schematic cross-sectional view illustrating sewn attachment of the reinforcement webbing strips to the rear side of the flexible banner.
Figure 6:
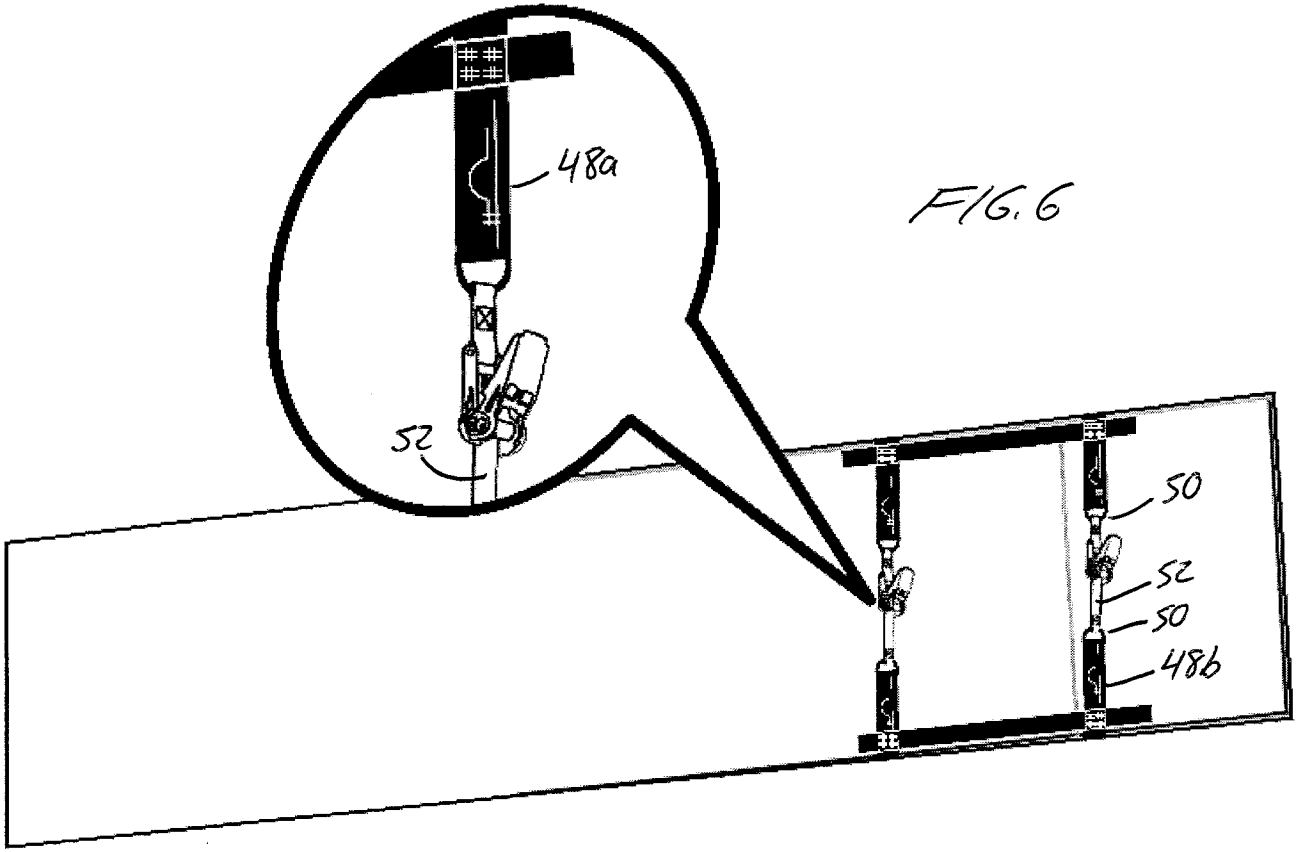
FIG. 6 is a perspective rear view of the flexible banner illustrating additional installation of securing straps to the rear side of the banner for use in tightly securing the banner and attached embellishment to the framework of a billboard support structure during installation of the display.

FIG. 1 illustrates a three-dimensional (3D) billboard display 10 of the present invention, which features a banner 12 in the form of a sheet of vinyl having advertisement, promotional or information content or indicia 14 printed on a front face 16 thereof, as is commonplace in the billboard industry. The front face 14 of the banner 12 refers to the side thereof that faces away from a billboard structure on which the banner will be installed, whereby the content 14 is visually exposed for viewing/reading thereof by passersby. Where the billboard display 10 differs from a conventional two-dimensional banner-only billboard display is in the addition of an inflatable embellishment 18 to the banner 12, which when inflated, bulges outward from the underlying banner 12 to contribute the 3D aspect of the overall display, as schematically shown in FIG. 4. Disclosed herein is a solution by which the inflatable embellishment is pre-installed in a factory or other setting prior to the installation of the banner on a billboard structure, thereby reducing the cost and complexity involved in the transport and installation of separate banner 3D embellishment components.

Figure 2:
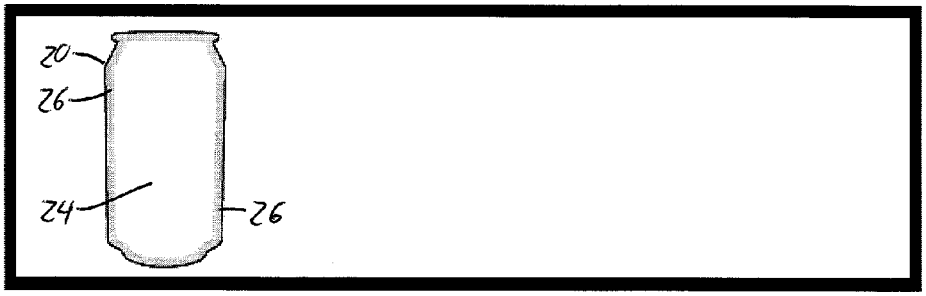
FIG. 2 is a rear elevational view of a flexible banner of the three-dimensional billboard display after a first step of production, in which an outline is printed on the banner to later service as a guide during installation of the an inflatable embellishment on the banner.
Figure 3:
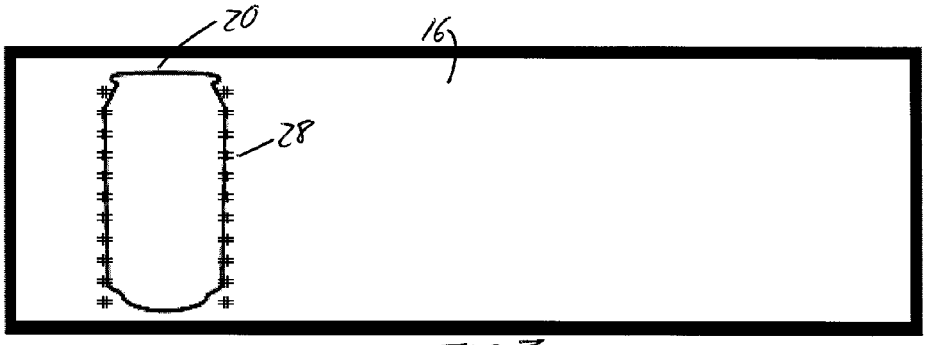
FIG. 3 is a front elevational view of the flexible banner of FIG. 2 after a second step of production, in which strips of webbing are sewn to the rear of the banner along sides out the outlined area in order to reinforce the banner where the embellishment will subsequently be attached thereto.

With reference to FIG. 2, an outline 20 of a two-dimensional base footprint of the inflatable embellishment 18 is printed on the banner 12 at an area thereof that is unoccupied by the advertisement, promotional or informational content 14. In one embodiment, the outline 20 is printed or drawn both the front face 16 of the banner 12, as well as the rear face 22, i.e. the side thereof that faces opposite the printed content 14 on the front face 16. In other embodiments, the outline may be printed only on the front face, for example being printed at the same time as the printed content 14 thereon, or only on the rear face. The footprint area 24 bound within the confines of the outline 20 denotes the portion of the banner 12 that will be concealed behind the inflatable embellishment 18 once attached to the banner 12. Around the perimeter of the footprint area 24, just inside the outline 20, strips of flat webbing 26 are laid along the perimeter of the footprint area 24 on the rear face 22 of the banner 12, and sewn thereto, as represented by schematically illustrated stitching 28 in FIG. 3. Printing or drawing of the outline on the rear face of the banner makes for easier layout of the webbing 26 around the footprint area, although other means of aligning with webbing with a front-face outline of the footprint area may alternatively be employed.

In the illustrated embodiment, the 3D embellishment has a generally semi-cylindrical shape in its inflated state so as to visually represent a conventional aluminum can of the type commonly used to package carbonated beverages. In such instance, the footprint area 24 includes an elongated rectangular area having a pair of parallel elongated sides representing opposing sides of the beverage can. A respective strip of webbing 26 is laid out along each side of the footprint area 24, and sewn to the banner. In the illustrated example, the strips of webbing 26 are laid out and sewn along vertically oriented sides of the footprint area, whereby the orientation of the simulated beverage can is an upright seated position. In the illustrated embodiment, no additional strips of webbing are installed along the outline 20 of the footprint area, but it will be appreciated that other embodiments may feature strips of webbing laid out around the full perimeter outline of the area 24. In embodiments where only select portions of the footprint outline 20 are provided with webbing, such select portions are not specifically limited to the illustrated example of vertically oriented sides of a rectangular portion of the footprint area.

The strips of webbing 26 attached to the flexible vinyl sheet define reinforced areas of the banner 12 at which the inflatable embellishment will be attached. The strong woven structure of the flat webbing 26 has significantly greater tear strength than the vinyl sheet, thus imparting the banner 12 with the reinforcement to support the embellishment 18 in a cantilevered state jutting from the front face of the banner 12 when the banner is installed on a billboard support structure. This way, no bolting or other direct fastening of the embellishment to the billboard support structure is required to install the 3D billboard display 10 of the present invention. Common synthetic webbing fabrics such as nylon, polyester, polypropylene may be used, although other webbing materials, whether synthetic or natural, may be used, provided that the resulting reinforcement strips of the banner provide suitable support strength for carrying the embellishment on the banner. Furthermore, it will be appreciated that the strips of reinforcement material are not limited exclusively to webbing, as other material structures providing greater strength than the banner's primary vinyl sheet may alternatively be used, provided the reinforcement material is sufficiently flexible so as to be foldable with the vinyl sheet into compact form for space and cost efficient shipping.

The 3D embellishment 18 features additional strips of this webbing or other reinforcement material 30, which are used in the attachment of the embellishment to the reinforced banner 12. The embellishment 18 features a flexible envelope that is formed of air impermeable material, encloses an inflatable air space within the envelope, and takes on a desired three-dimensional form when this internal air space is inflated, as is well known in the art of promotional inflatables. In the illustrated semi-cylindrical example, the flexible envelope 32 of the embellishment 18 features a generally rectangular base or rear panel 34, a pair of semi-circular top and bottom panels 36, 38 whose flat sides are seamed together with the two shorter edges of the rear panel 34 at the top and bottom ends thereof, and a rectangular front panel 40 whose top and bottom edges are seamed together with the arcuate edges of the semi-circular panels 36, 38, and whose left and right edges or ends are seamed with the longer upright edges of the rear panel 34. These panels collectively enclose the interior inflatable airspace, and cause the envelope to take on a semi-cylindrical 3D shape when inflated. In the illustrated embodiment, the additional strips of webbing 30 comprise two strips of equal length that are sewn to a front face of the rear panel 34 (i.e. the side thereof that faces the opposing front panel 40) along the vertically oriented seams formed between the rear panel and the ends of the front panel 40. These additional vertical strips of webbing 30 are equal, or nearly equal, in length to the two vertical strips of webbing 26 on the banner 12. The rear panel 34 of the flexible envelope 32 matches the size and shape of the footprint area 24 of the banner 12, whereby the perimeter edges of the rear panel can be aligned over the outline 20 on the banner, which will automatically place the embellishment's additional strips of webbing 30 in respective alignment over the strips of webbing 26 on the banner. Printing of the outline 20 on the front face of the banner allows easy visual alignment of the rear panel of the embellishment envelope with the footprint area of the banner, although in other embodiments lacking a front face outline of the footprint area, suitable alignment may still be achieved, for example by physically 'feeling out' the reinforcement strips 26 on the rear face of the banner from the front face thereof in order to align the reinforcement strips 30 of the flexible envelope with those of the banner.

In the illustrated embodiment, the embellishment is pre-assembled before attachment to the banner 12. In order to facilitate sewing of the webbing-reinforced rear panel 34 of the embellishment envelope 32 to the reinforced banner 12, a series of zippered openings 42 are provided in the front panel 40 and top and bottom panels 36, 38 at locations adjacent to the seamed connections thereof to the rear panel 34, thus providing a series of selectively openable and closable access points to the interior inflatable space of the embellishment at discrete, but closely spaced, positions around the periphery of the embellishment 18. To install the embellishment on the banner 12, first the banner 12 is laid out flat, for example atop the floor or other sufficiently large surface, with the front face 12 of the banner facing upward. Then the rear base panel 34 of the embellishment's flexible envelope 32 is laid out in alignment over the footprint area 24 of the banner 12. The zippered access points 42 are opened up, whereby assembly or production personnel can reach into the interior space of the envelope through one of the access openings 42 and sew a seam of stitches through the reinforcement strap 30 and underlying rear panel 34 of the embellishment, and through the banner's flexible sheet 12 and underlying reinforcement strap 26. The sewer can then move to the next zippered access point 42 and continue sewing the embellishment and banner together along the respective pair of webbing strips 26, 30 running up the respective side of the embellishment and banner footprint area. Moving from one zippered access point to the next, the sewer eventually sews the full length of the webbing strips 30 on the embellishment envelope to the full length of the webbing strips 26 on the banner 12, thereby securely fastening the embellishment 18 to the banner 12.

The zippered access points 42 thus allow the embellishment to be sewn to the banner 12 from the front side thereof, thereby avoiding the risk that the stitching is threaded through more than just the rear panel 34 and webbing 30 of the embellishment if it were instead sewn from the rear side of the banner. On the other hand, sewing of the banner and embellishment together from the rear side of the banner may be possible if appropriate precaution, care or preventive means is employed in order to limit the stitching to the reinforced rear panel of the embellishment envelope and ensure the other panels of the embellishment remain unsewn and free to move away from the banner and rear envelope panel during inflation of the envelope. With webbing strips 26, 30 on opposing sides of the banner and the rear panel 34 of the embellishment envelope 32, and the stitching sewn through both sets of webbing strips 26, 30 and the banner 12 and rear envelope panel 34 therebetween, this sandwiched multi-layer configuration provides a robust connection of the inflatable embellishment to the banner 12 that avoids the need for any separate auxiliary support of the embellishment.

A self-inflation mechanism 44 is attached to the flexible envelope 32, is substantially contained within the interior space of the envelope, and features a powered fan that is operable to draw air into the interior space from the surrounding ambient environment outside the envelope in order to automatically inflate the envelope and thereby expand the embellishment into its deployed state of predetermined shape. The self-inflation means is detachably coupled to the flexible envelope, for example by zippered connection, whereby it can be removed and replaced in the event of failure without requiring removal of the flexible envelope from the banner 12 or removal of the banner from the billboard support structure. Removable self-inflation mechanisms of this type are well known in the field of promotional inflatables, and so further details of same are omitted herein.

The banner and inflatable embellishment may be manufactured and assembled by the same entity, or manufactured by separate entities and then assembled by one of those manufacturing entities, or by another party. In one scenario, a printing company with suitable large-scale printing equipment produces the vinyl banner, and ships same to an inflatable manufacturer who assembles the inflatable embellishment to the banner, and ships the resulting single-piece three-dimensional display product 10 to a billboard installer who then mounts the product to a suitable billboard support structure. The printer may include the footprint outline 20 as part of the original banner printing process, or the outline may be drawn or printed onto the banner after the fact by the assembler, at an available area on the banner that the printer left free of any readable content intended to be visible in the final 3D display installation.

Turning to FIGS. 6 to 9, the banner 12 may incorporate securing straps sewn to the strips of webbing 26 on the rear side of the banner 12 to enable better anchoring of the embellishment-carrying footprint area 24 of the banner 12 to the billboard support structure 100 in view of the greater weight of the 3D billboard display 100 relative to a conventional 2D banner-only billboard display. The straps may be arranged in pairs, in which each pair features an upper strap 48*a* and corresponding lower strap 48*b*, which are sewn to one of the reinforcement webbing strips 26 of the banner 12 near the top and bottom ends thereof, respectively. A connection ring, such as a metal D-ring 50, is fixed to a free end of each securing strap 48*a*, 48*b*, whereby a ratchet strap 52 can be engaged through the two D-rings 50 of the pair in order to form a closed, tightenable loop that passes through the two D-rings 50 such that tightening of the ratchet strap 52 pulls the free ends of the two securing straps 48*a*, 48*b* together.

Figure 7:
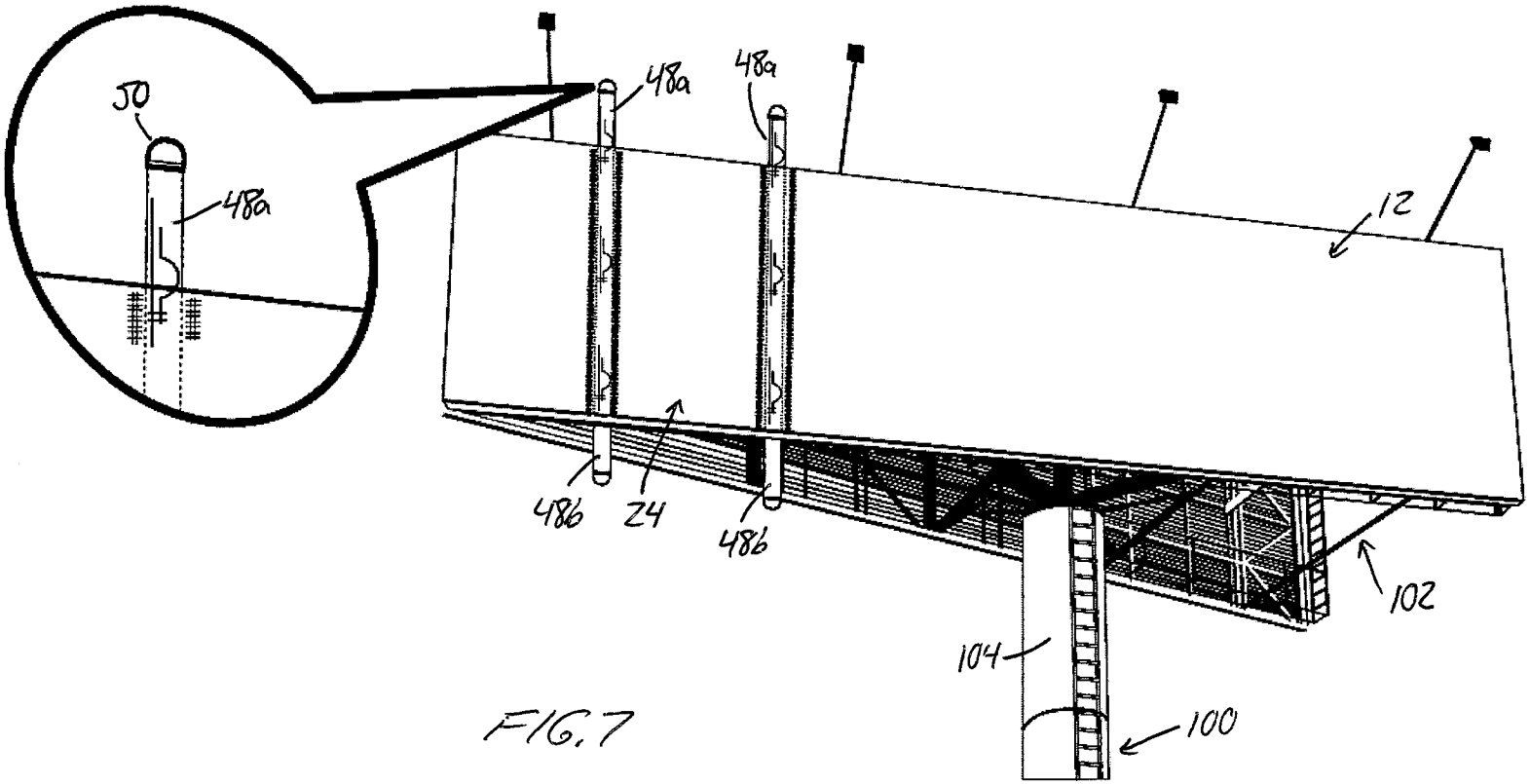
FIG. 7 is a perspective front view of the flexible banner of FIG. 6, with the inflatable embellishment omitted for illustrative purposes, during installation of the display on the framework of the billboard support structure.

FIG. 7 shows the banner 12 in a conventional installed position laid out flat over a framework 102 that is mounted atop an upright column or post 104 of a billboard support structure 100. The banner 12 may be laid over a plywood facing 106 or other substrate at the front side of the framework 102 from which the billboard is to visibly face outward. At least partly held in this position by conventional means, additional support is provided through use of the securing straps. The upper securing strap 48*a* of each pair reaches upwardly from behind the banner 12, and the matching lower securing strap 48*b* reaches downwardly from behind the banner 12. The installation personnel pull the upper securing strap 48*a* over the top edge of the plywood facing 106 and downwardly along the rear side thereof, pull the lower securing strap 8*b* under the bottom edge of the plywood facing 106 and upwardly along the rear side thereof, and then connect the ratchet strap 52 between the D-rings 50 of the securing straps 48*a*, 48*b*. In their connection with one another behind the facing 106 of the framework 102, the securing and ratchet straps 48*a*, 48*b*, 52 may pass behind one or more horizontal frame members of the framework 102 to which the facing 106 is mounted. Tightening of the ratchet strap 52 acts to cinch the straps 48*a*, 48*b*, 52 into a snug position around the facing 106 and frame members, thereby pulling the footprint area 24 of the banner 12 tightly against the facing 106 in order to aid in support of the 3D embellishment that is cantilevered from the front side of the banner 12 when inflated.

As shown in FIG. 9, instead of discrete upper and lower straps 48*a*, 48*b*, the two strap segments connected together by the ratchet strap 52 may instead be integral parts of a single unitary strap 48' that is sewn to one or more reinforcement straps of the banner 12 in a manner spanning the full height of the banner. Either way, the resulting closure of one or more straps around the facing and/or frame members of the support structure 100 tightly embraces over and under the top and bottom edges of the facing and/or frame members and thereby aids in reliable securing of the 3D display to the billboard support structure 100. The use of separate ratchet straps may be avoided by instead equipping the securing straps with their own ratcheting mechanisms. However, use of a separate mechanism avoids potential waste of a perfectively good ratchet when the advertising campaign is over and the 3D display is to be disposed of. As a discrete component, the separate ratchet strap 52 can be re-used for a subsequent 3D installation on the same, or another, billboard support structure.

In the illustrated embodiment, the flexible envelope is an enclosed structure that alone forms the inflatable space of the overall three-dimensional display product. In other embodiments, the rear side of the embellishment could be at least partly open at areas thereof located inwardly of the envelopes reinforcement strips 30, in which case the footprint area 24 of the banner would cooperate with the open-backed flexible envelope to effectively enclose the inflatable space. The fan or blower of self-inflating mechanism may be run on a continuous basis, in which case the inflatable space need not be perfectly and fully sealed, as the continuous fan or blower will keep the space pressurized and inflated. Accordingly, it may not be necessary to sew the inflatable and embellishment together around the full perimeter of the envelope, and fully air-tight closure of the zippered access points 42 need not be accounted for.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A three-dimensional billboard display comprising:

a flexible sheet of banner material having advertisement, promotional or informational content on a display side of said flexible sheet;

strips of reinforcement material attached to said flexible sheet in positions lying along boundaries of a two-dimensional area;

a flexible envelope fastened to the strips of reinforcement material and carried on the flexible sheet on the display side thereof in a position overlying the two-dimensional area and forming an inflatable space enclosed by the flexible envelope, or a by a combination of said flexible envelope and said flexible sheet;

whereby inflation of the inflatable space expands the flexible envelope in a manner bulging away from the display side of the flexible sheet to create a three-dimensional display unit on said flexible sheet of banner material;

wherein the strips of reinforcement material have a greater tear strength than the flexible sheet of banner material and are flexible and foldable together therewith.

2. A three-dimensional billboard display comprising:

a flexible sheet of banner material having advertisement, promotional or informational content on a display side of said flexible sheet;

strips of reinforcement material attached to said flexible sheet in positions lying along boundaries of a two-dimensional area; and a flexible envelope fastened to the strips of reinforcement material and carried on the flexible sheet on the display side thereof in a position overlying the two-dimensional area and forming an inflatable space enclosed by the flexible envelope, or a by a combination of said flexible envelope and said flexible sheet, whereby inflation of the inflatable space expands the flexible envelope in a manner bulging away from the display side of the flexible sheet to create a three-dimensional display unit on said flexible sheet of banner material;

wherein the strips of reinforcement material are attached to a rear side of the flexible sheet that faces opposite the display side thereof, and the flexible envelope is fastened to the strips of reinforcement material through the flexible sheet.

3. The three-dimensional billboard display of claim 2 comprising additional reinforcement strips attached to the flexible envelope and fastened to the flexible sheet at the display side thereof.

4. The three-dimensional billboard display of claim 3 wherein the additional reinforcements strips are fastened to the strips of reinforcement material through the sheet of flexible material.

5. The three-dimensional billboard display of claim 3 wherein the additional reinforcement strips comprise webbing.

6. The three-dimensional billboard display of claim 5 wherein the strips of reinforcement material comprise webbing.

7. The three-dimensional billboard display of claim 2 comprising at least one securing strap attached to the flexible sheet at the rear side thereof, wherein the at least one securing strap is arranged to secure the flexible sheet securely to a billboard support structure and comprises a same fabric as the strips of reinforcement material.

8. The three-dimensional billboard display of claim 7 wherein the at least one securing strap is attached to at least one of the strips of reinforcement material.

9. The three-dimensional billboard display of claim 2 wherein the strips of reinforcement material have a greater tear strength than the flexible sheet of banner material and are flexible and foldable together therewith.

10. The three-dimensional billboard display of claim 2 wherein the strips of reinforcement material comprise webbing.

11. The three-dimensional billboard display of claim 2 wherein the flexible envelope is sewn to the flexible sheet and the strips of reinforcement material.

12. The three-dimensional billboard display of claim 1 wherein the flexible envelope is sewn to the strips of reinforcement material.

13. The three-dimensional billboard display of claim 1 wherein the strips of reinforcement material comprise webbing.

14. The three-dimensional billboard display of claim 1 comprising at least one securing strap attached to the flexible sheet at a rear face thereof that faces opposite the display side of the flexible sheet, wherein the at least one securing strap is arranged to secure the flexible sheet securely to a billboard support structure and comprises a same fabric as the strips of reinforcement material.

15. The three-dimensional billboard display of claim 14 wherein the at least one securing strap is attached to at least one of the strips of reinforcement material.

16. The three-dimensional billboard display of claim 1 comprising additional reinforcement strips attached to the flexible envelope and fastened to the flexible sheet on a side thereof opposite the reinforcement strips.

17. The three-dimensional billboard display of claim 16 wherein the additional reinforcements strips are fastened to the strips of reinforcement material through the sheet of flexible material.

18. A flexible banner for use in a three-dimensional billboard display, the flexible banner comprising a flexible sheet of banner material having advertisement, promotional or informational content on a display side of said flexible sheet; and strips of reinforcement material attached to said flexible sheet in positions lying along boundaries of a two-dimensional area to enable fastening of a flexible envelope to the strips of reinforcement material on the display side of the flexible sheet in a position overlying the two-dimensional area and forming an inflatable space that is enclosed by the flexible envelope, or by a combination of said flexible envelope and said flexible sheet, such that inflation of the inflatable space will expand the flexible envelope in a manner bulging away from the display side of the flexible sheet to create a three-dimensional display unit on said flexible sheet of banner material, wherein the strips of reinforcement material are attached to a rear side of the flexible sheet that faces opposite the display side thereof.

19. A flexible banner for use in a three-dimensional billboard display, the flexible banner comprising a flexible sheet of banner material having advertisement, promotional or informational content on a display side of said flexible sheet; and strips of reinforcement material attached to said flexible sheet in positions lying along boundaries of a two-dimensional area to enable fastening of a flexible envelope to the strips of reinforcement material on the display side of the flexible sheet in a position overlying the two-dimensional area and forming an inflatable space that is enclosed by the flexible envelope, or by a combination of said flexible envelope and said flexible sheet, such that inflation of the inflatable space will expand the flexible envelope in a manner bulging away from the display side of the flexible sheet to create a three-dimensional display unit on said flexible sheet of banner material, wherein the strips of reinforcement material have a greater tear strength than the flexible sheet of banner material and are flexible and foldable together therewith.

* * * * *